US007287878B2

(12) United States Patent
Miller

(10) Patent No.: US 7,287,878 B2
(45) Date of Patent: Oct. 30, 2007

(54) LED SIGN COVER AND METHOD OF MANUFACTURE

(75) Inventor: William H. Miller, Raleigh, NC (US)

(73) Assignee: Digital Recorders, Inc., Dallas, TX (US)

( * ) Notice: Subject to any disclaimer, the term of this patent is extended or adjusted under 35 U.S.C. 154(b) by 18 days.

(21) Appl. No.: 10/869,305

(22) Filed: Jun. 16, 2004

(65) Prior Publication Data

US 2004/0264206 A1 Dec. 30, 2004

Related U.S. Application Data

(60) Provisional application No. 60/480,965, filed on Jun. 24, 2003.

(51) Int. Cl.
*F21V 11/02* (2006.01)

(52) U.S. Cl. ..... 362/282; 362/283; 362/290; 362/342; 362/812

(58) Field of Classification Search ..... 345/32; 362/235–37, 248, 290, 354, 545, 548, 512, 362/277, 282, 283, 242, 812; 160/130; 40/442
See application file for complete search history.

(56) References Cited

U.S. PATENT DOCUMENTS 1,363,805 A * 12/1920 Morrison ..... 362/339
2,182,957 A * 12/1939 Blanck ..... 446/140
2,540,389 A * 2/1951 Fowler ..... 362/290
2,701,298 A * 2/1955 Michailovsky ..... 362/354
3,083,630 A * 4/1963 Thaxton ..... 454/128
3,604,922 A * 9/1971 Steel ..... 362/283
3,745,355 A * 7/1973 Seamon ..... 250/568
4,232,483 A * 11/1980 Lockshin ..... 49/67
4,368,605 A * 1/1983 Ulrich ..... 52/473
5,140,495 A * 8/1992 Varvel ..... 361/220
5,299,111 A * 3/1994 Parduhn et al. ..... 362/290
5,390,092 A * 2/1995 Lin ..... 362/235
5,949,581 A * 9/1999 Kurtenbach et al. ..... 359/621
5,950,753 A * 9/1999 Muldoon et al. ..... 180/68.1
6,095,668 A * 8/2000 Rykowski et al. ..... 362/350
6,170,566 B1 * 1/2001 Blumel et al. ..... 165/152
6,550,937 B2 * 4/2003 Glass ..... 362/290
6,626,560 B1 * 9/2003 Caferro et al. ..... 362/290
2004/0148829 A1 * 8/2004 Gray et al. ..... 40/452

* cited by examiner

*Primary Examiner*—Thomas M. Sember
(74) *Attorney, Agent, or Firm*—Howison & Arnott, L.L.P.

(57) ABSTRACT

A cover for a LED sign is manufactured from a stainless steel sheet that is dimensionally larger than the array of light emitting diodes comprising the LED sign. The stainless steel sheet is laser cut and then bent to simultaneously form a plurality of apertures and a corresponding plurality of louvers each extending adjacent one of the apertures. The apertures facilitate viewing of the LED sign and the louvers shield the light emitting diodes comprising the LED sign from excessive light.

13 Claims, 7 Drawing Sheets

LED SIGN COVER AND METHOD OF MANUFACTURE

CLAIM OF PRIORITY

This application claims priority of prior provisional Application Ser. No. 60/480,965 filed Jun. 24, 2003.

TECHNICAL FIELD

This invention relates generally to signs of the type used on buses and other urban transit vehicles to display route information and other information, and more particularly to improvements in the construction of covers for LED (light emitting diode) signs.

BACKGROUND AND SUMMARY OF THE INVENTION

The Americans with Disabilities Act requires buses and other urban transit vehicles to display route information and other information in an easily readable format. For example, in addition to the route number the vehicle may be provided with signage which identifies the general direction of movement of the vehicle, i.e., downtown, west end, etc. One of the more popular signage types that is utilized on urban transit vehicles for the foregoing purposes comprises LED (light emitting diode) displays.

LED signage is popular because it provides a high contrast image which can be read and understood by persons with highly impaired vision. Because LED signs are entirely electronic the information displayed thereon can be changed virtually instantly, for example, if the vehicle is assigned to a different route. Another advantage in the use of LED signage comprises the fact that the same sign can be used to sequentially display a variety of messages.

One problem that has been encountered in utilization of LED signage on urban transit vehicles involves degradation of the image displayed by the sign due to sunlight and other sources of bright light. Thus, when a LED sign is used in the presence of sunlight or other bright light, the contrast normally associated with a LED sign can be reduced to the point that the sign is hard to read. To overcome this problem LED signs have been provided with covers including louvers which shield the light emitting diodes thereof from excessive light.

In accordance with the present invention, a LED sign comprises a rectangular array of individual light emitting diodes. A cover having dimensions corresponding to those of the rectangular array is positioned in front of the light emitting diodes. A cover is provided with closely spaced, parallel, horizontally disposed slots which expose substantially the entirety of the array of light emitting diodes. Each of the slots is provided with a louver which shields the light emitting diodes from bright light emanating from the sun or any other source. The louvers prevent degradation of the image vented by the LED sign due to impingement of excessive light on the light emitting diodes.

In accordance with more specific aspects of the invention, a LED sign cover comprises a stainless steel sheet which is laser cut to define a relatively long first cut line and two relatively short second cut lines which extend angularly from the opposite ends of the first cut line. Following the cutting step the portion of the stainless steel sheet extending between the two second cut lines is bent relative to the plane of the stainless steel sheet. Bending of the portion of the stainless steel plate extending between the two second cut lines simultaneously forms both an aperture through the stainless steel sheet and a louver extending adjacent to the aperture for shielding the light emitting diode of the LED sign from excessive light.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
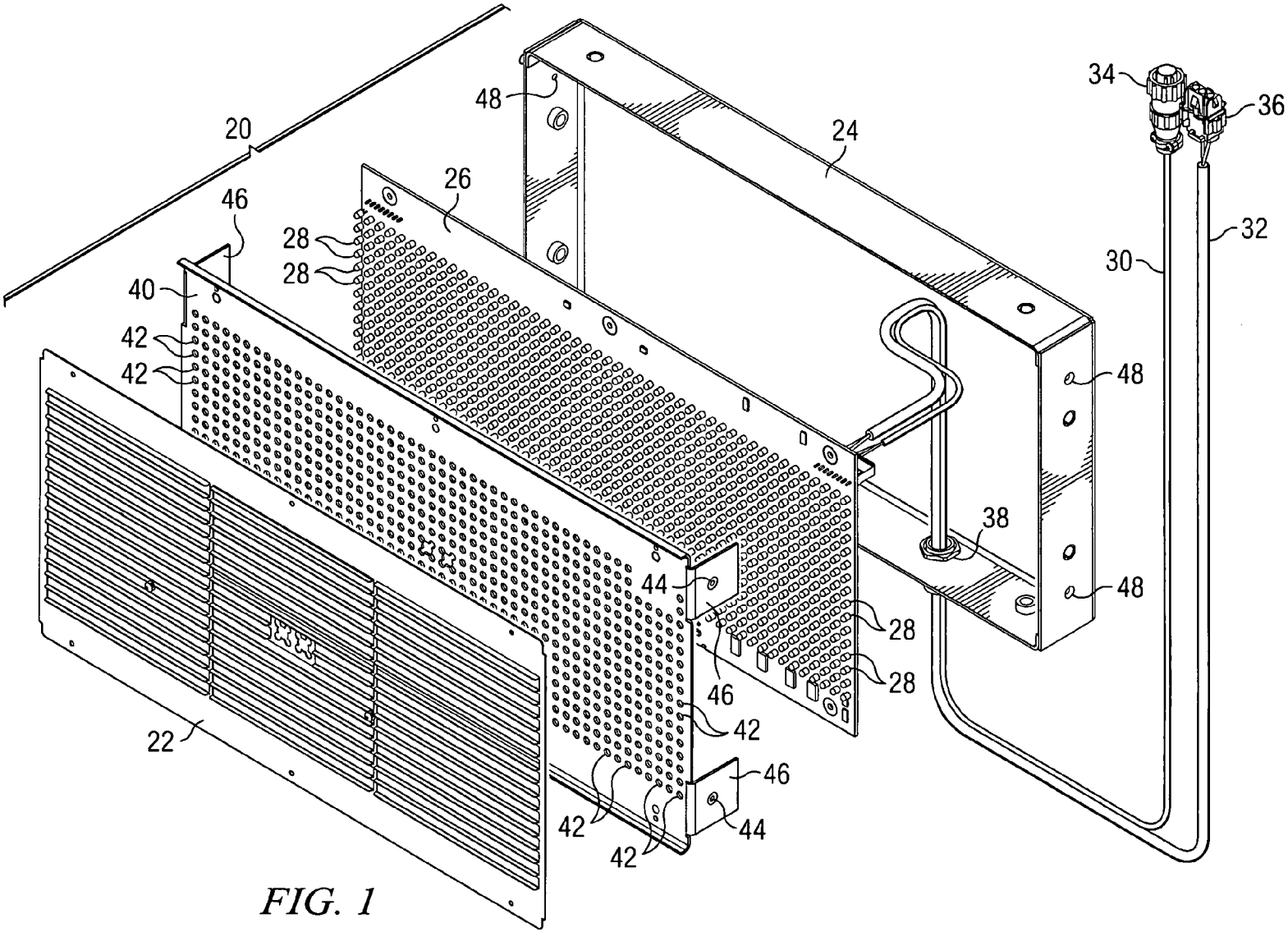
FIG. 1 is an exploded perspective view illustrating a LED sign having a cover comprising a first embodiment of the present invention.

Referring now to the Drawings, and particularly to FIG. 1 thereof, there is shown a LED sign 20 equipped with a LED sign cover 22 comprising a first embodiment of the present invention. The LED sign 20 includes a housing 24 which receives and supports a circuit board 26 having an array of light emitting diodes 28 mounted thereon. The array of light emitting diodes 28 is characterized by a relatively long horizontal dimension and a relatively short vertical dimension. Operating power and control signals for the array of light emitting diodes 28 are directed to a plurality of electronic components mounted on the reverse side of the circuit board 26 through a pair of cables 30 and 32 which extend from connectors 34 and 36, respectively, through an aperture 38 formed in the housing 24.

The LED sign 20 further includes a front plate 40 having a plurality of apertures 42 formed therethrough. Each of the apertures 42 receives, supports, and protects one of the light emitting diodes 28 mounted on the circuit board 26. The front plate 40 is secured to the housing 24 by fasteners which extend through apertures 44 formed in tabs 46 extending rearwardly from the front plate 40 and apertures 48 extending through the housing 24.

The cover 22 for the LED sign 20 is further illustrated in FIGS. 2, 3, 4, and 5. The cover 22 is formed from a plate 52 which is preferably formed from stainless steel. Other materials may be utilized in the manufacture of the cover 22 provided that the material selected for the manufacture of the cover 22 is opaque. The plate 52 has a plurality of apertures 54 formed therein. The function of the apertures 54 is to facilitate viewing the light emitting diodes 42 comprising the LED sign 20.

Figure 2:
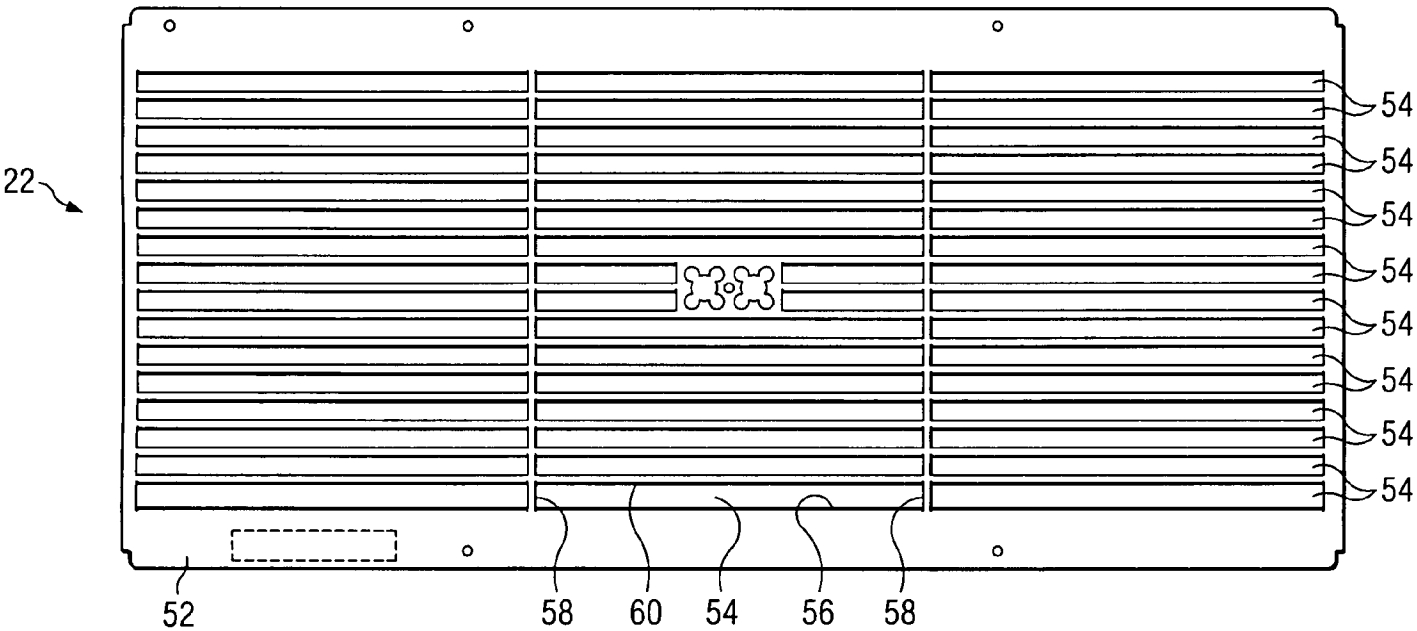
FIG. 2 is a front view of the LED sign cover of FIG. 1.
Figure 3:
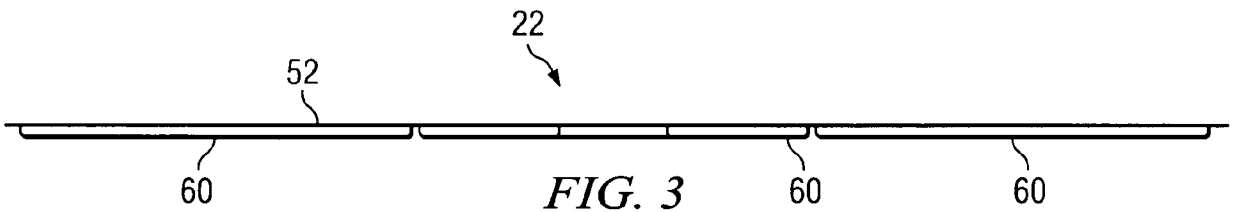
FIG. 3 is a top view of the LED sign cover of FIG. 1.
Figure 6:
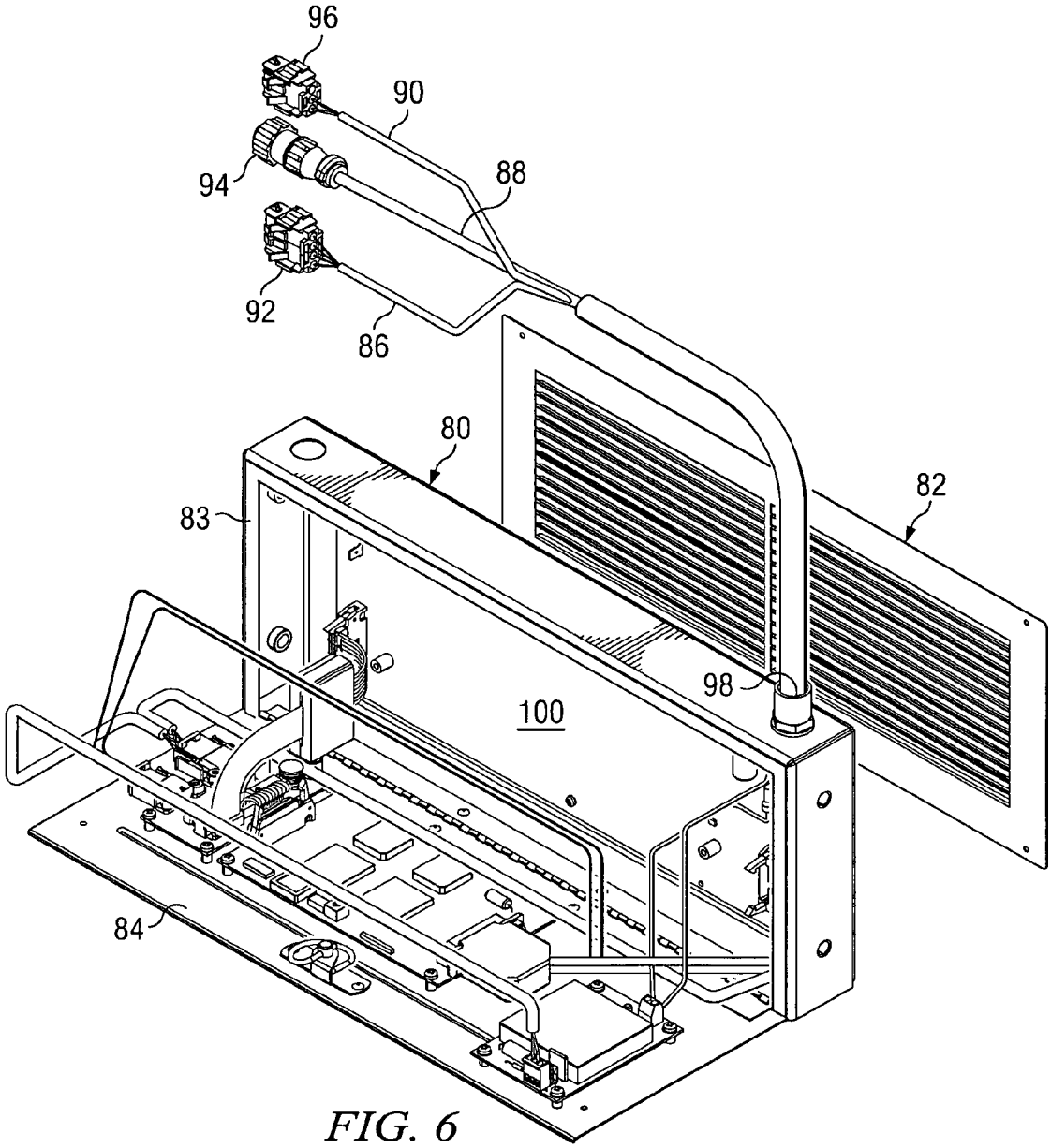
FIG. 6 is an exploded perspective view of a LED sign having a cover comprising a second embodiment of the invention.

As will be apparent by reference to FIG. 2, the apertures 54 comprising the cover 22 are substantially identical in size and shape. Moreover, the apertures 54 extend substantially parallel to one another. As will be understood by those skilled in the art, other aperture configurations can be utilized in the practice of the invention.

Each of the apertures 54 is fabricated by forming a relatively long first cut line 56 and two relatively short second cut lines 58 in the stainless steel plate 52. The second cut lines 58 extend angularly relative to the first cut line 56 from the opposite ends thereof. As illustrated in FIG. 2, the second cut lines 58 may extend perpendicularly relative to the first cut line 56, however, angular relationships between the first cut line 56 and the second cut lines 58 may be utilized in the practice of the invention depending upon the requirements of particular applications thereof.

The first and second cut lines 56 and 58 are formed in the stainless steel sheet 52 utilizing a laser cutter. Multiple passes in the laser cutter may be required in order to form cut lines 56 and 58 having adequate width. After the cut lines 56 and 58 are formed, the portion of the stainless steel plate 52 extending between the two second cut lines 58 is bent out of the plane of the plate 52. A machine tool of the type known as a break is preferably utilized to bend the portion of the stainless steel plate 52 extending between the second cut lines 58 relative to the remainder thereof.

Bending of the portion of the plate 52 extending between the second cut lines 58 relative to the remainder of the plate 52 simultaneously forms both the aperture 54 and a louver 60 extending adjacent to the aperture 54. As stated above, the function of the apertures 54 is to facilitate viewing of the array of light emitting diodes 28 comprising the LED sign 20. The function of the louvers 60 extending adjacent to the apertures 54 is to shield light emitting diodes 28 from excessive light which would otherwise denigrate the contrast between the light emitting diodes and the background thereof thereby hindering the ability of visually impaired persons to read the LED sign 20.

Figure 4:
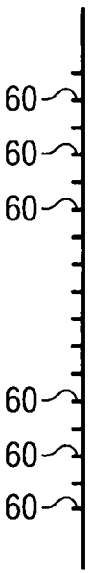
FIG. 4 is a side view of the LED sign cover of FIG. 1.
Figure 5:
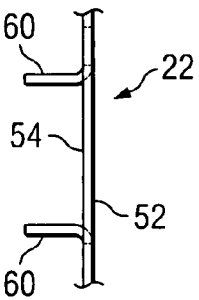
FIG. 5 is an enlargement of the lower portion of FIG. 4.

The louvers 60 are further illustrated in FIGS. 4 and 5. Most of the louvers 60 are located along the upper edge of the corresponding aperture 54. However, as is indicated in FIG. 5, a louver 60 may be provided along the lower edge of the lowermost aperture 54 of the cover 22. FIGS. 4 and 5 further illustrate the louvers 60 as extending substantially perpendicularly relative to the plane of the stainless steel plate 52. However, the louvers which are located along the upper edges of the apertures 54 may extend angularly downwardly from the perpendicular orientation illustrated in FIGS. 4 and 5. If the louvers 60 are bent into an angularly downwardly extending orientation, the extent of downward inclination of the louvers 60 from the perpendicular orientation shown in FIGS. 4 and 5 is typically between about zero degrees and about 10 degrees.

The use of a laser cutting to form the cut lines 56 and 58 which define the apertures 54 and the use of the break to bend the portion of the stainless steel plate 52 extending between the second cut lines 58 thereby forming the apertures 54 and the louvers 60 comprises an important feature of the invention. By means of the present invention the expensive molds, dies, and/or other tooling which have heretofore been required to manufacture louvered cover plates for LED signs is eliminated. Thus, use present invention substantially reduces the cost of manufacturing LED sign covers. Another important advantage deriving from the use the invention comprises the fact that individual covers can be manufactured; that is, the necessity of forming multiple identical covers in order to amortize the cost of tooling necessary to make the covers is eliminated. Still another advantage deriving from the use of the present invention involves the fact that by means thereof covers for existing LED signs can be economically and rapidly fabricated. Yet another advantage deriving from the use of the invention comprises the fact that new cover designs can be produced quickly and economically.

Referring to FIGS. 6-11, inclusive, there is shown a LED sign 80 having the cover 82 comprising the second embodiment of the invention. The LED sign 80 includes a housing 83 having a back plate 84 hingedly mounted thereon. The back plate 84 supports a plurality of electronic components which drive and control the operation of the LED sign 80. Operating power and control signals are directed to the LED sign 80 through a plurality of cables 86, 88, and 90 which extends from a plurality of connectors 92 and 94 to the operating components of the LED sign 80 through an aperture 98.

The LED sign 80 further includes a printed circuit board 100 which is operatively connected to the electronic components mounted on the back plate 84 of the housing 83. The printed circuit board 100 has an array of light emitting diodes mounted on the reverse side thereof. The array of light emitting diodes is characterized by relatively long horizontal dimension and a relatively short vertical dimension.

Figure 7:
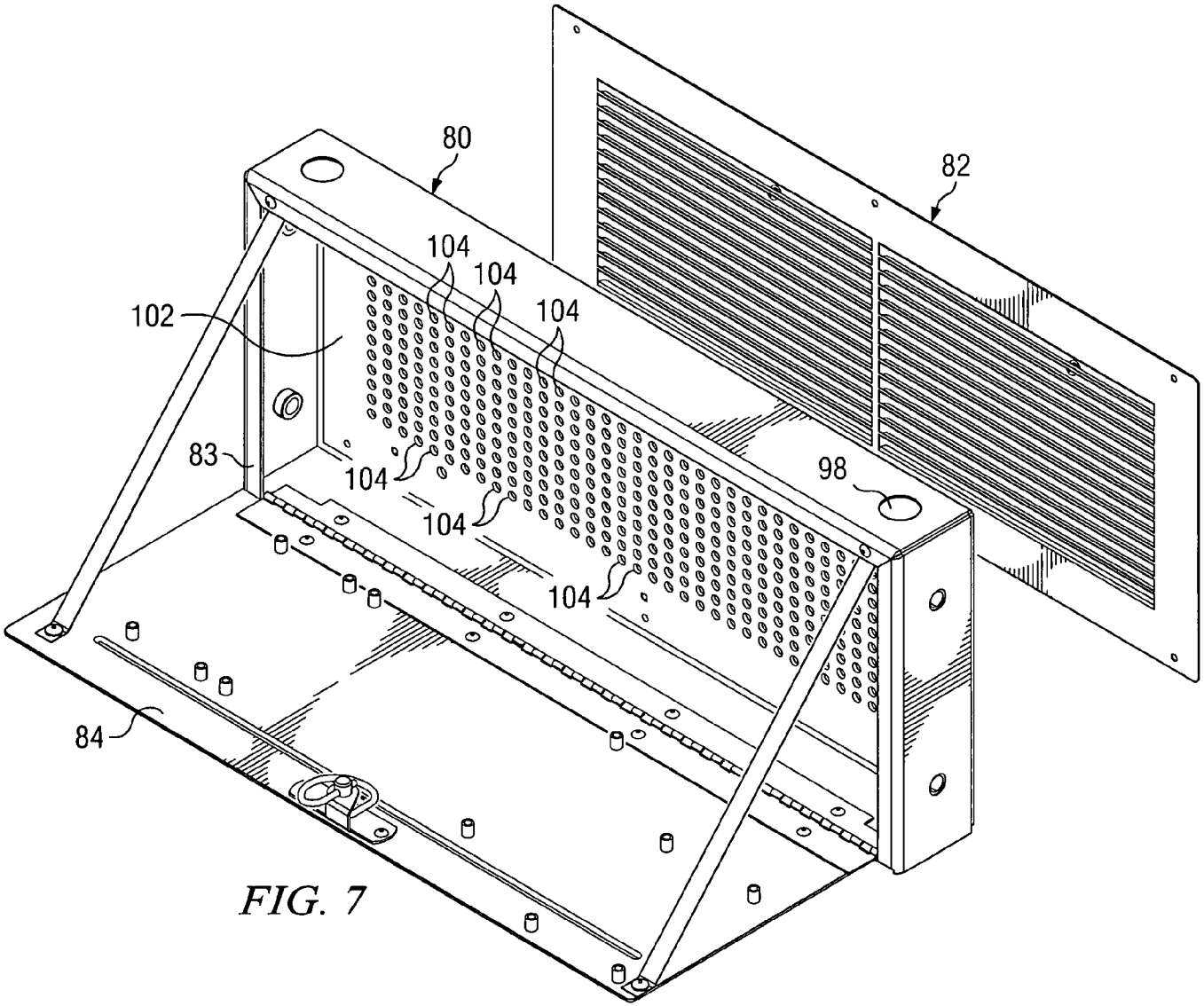
FIG. 7 is an exploded perspective view showing the LED sign of FIG. 6 at an earlier stage in its manufacture.
Figure 8:
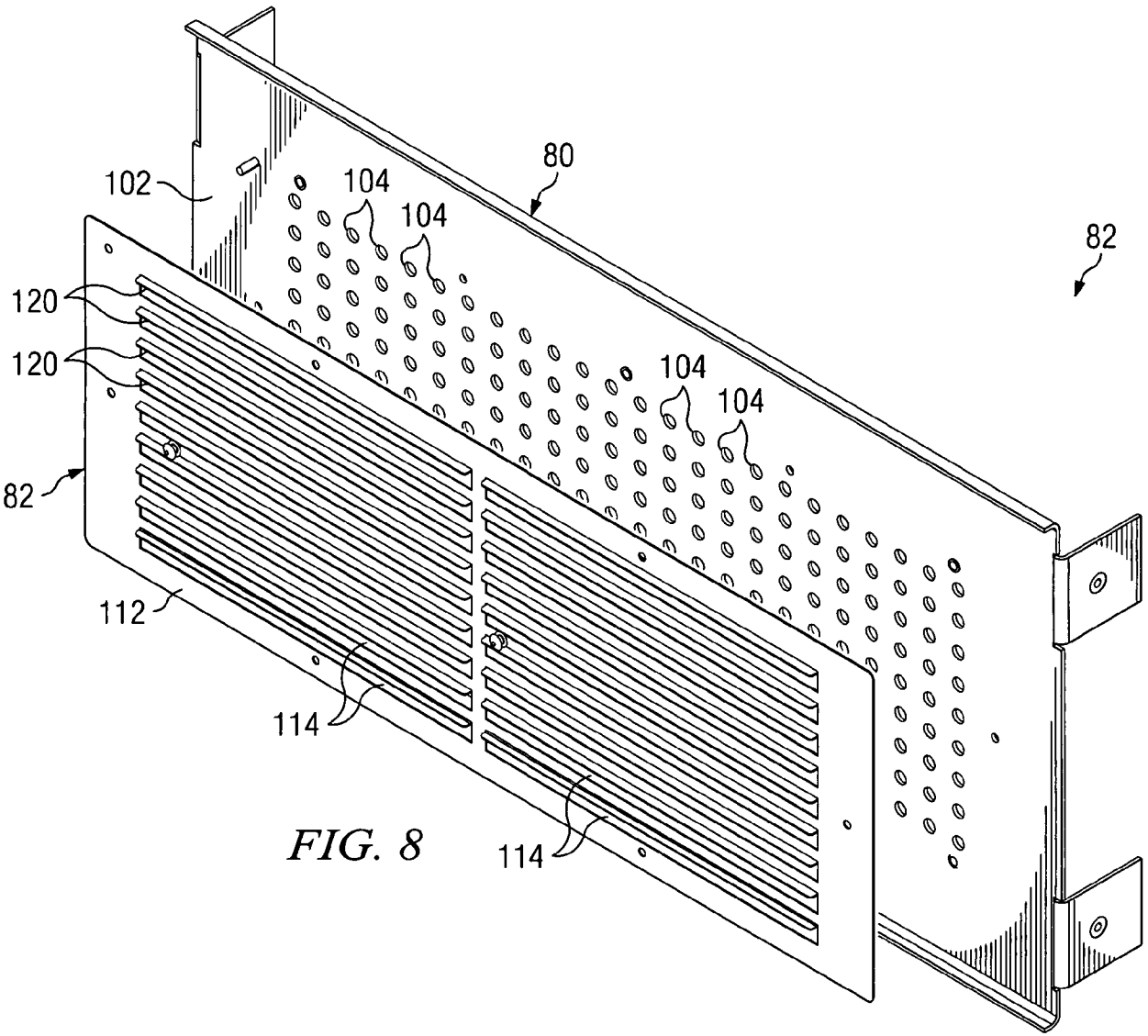
FIG. 8 is an exploded perspective view showing the LED sign of FIG. 6 of at a still earlier stage in its manufacture.

Referring to FIG. 7, the housing 83 of the LED sign 80 further comprising a front plate 102. The front plate 102 has an array of light emitting diode receiving apertures formed therein. Each of the apertures 104 receives, positions, and protects one of the light emitting diodes mounted on the printed circuit board 100. Thus, the array of apertures 104 as illustrated in FIG. 7 corresponds identically to the array of light emitting diodes mounted on the printed circuit board 100.

Figure 11:
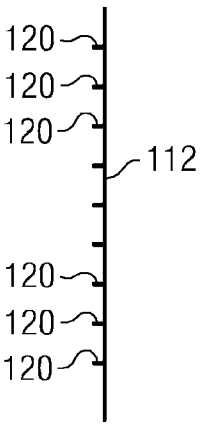
FIG. 11 is a side view of the LED sign cover of FIG. 6.
Figure 9A:
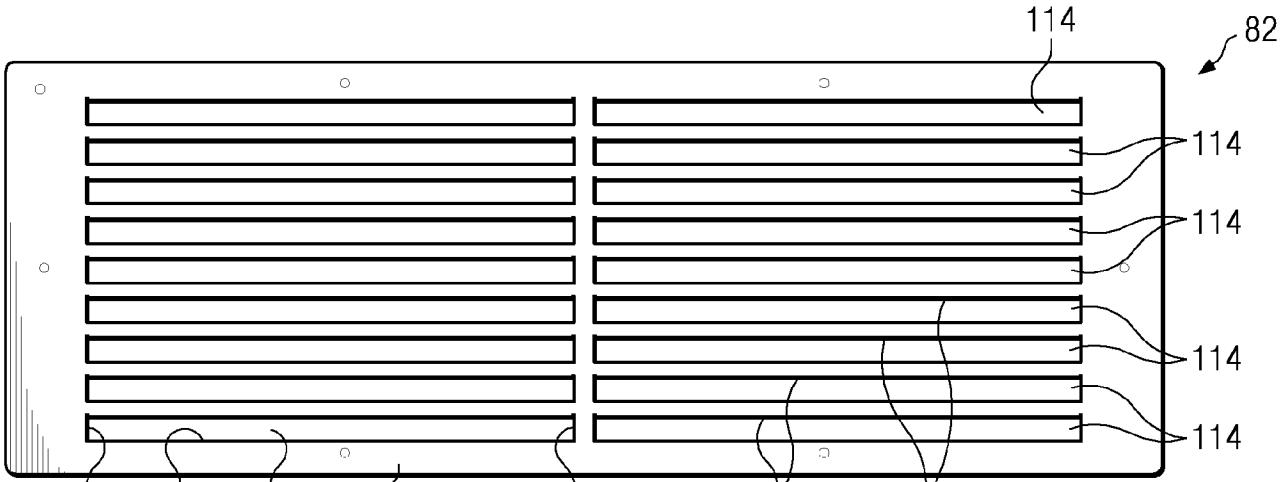
FIGS. 9*a* and 9*b* are front views of the LED sign cover of FIG. 6.
Figure 10:
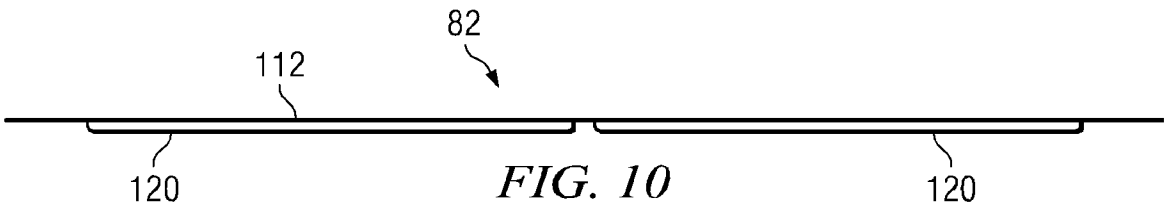
FIG. 10 is a top view of the LED sign cover of FIG. 6.

The cover 82 for the LED sign 80 is further illustrated in FIGS. 9, 10, and 11. The cover 82 is formed from a plate 112 which is preferably formed from stainless steel. Other materials may be utilized in the manufacture of the cover 82 provided that the material selected for the manufacture of the cover 82 is opaque. The plate 112 has a plurality of apertures 114 formed therein. The function of the apertures 114 is to facilitate viewing the light emitting diodes comprising the LED sign 80.

As will be apparent by reference to FIG. 9*a*, the apertures 114 comprising the cover 82 are substantially identical in size and shape. Moreover, the apertures 114 extend substantially parallel to one another. As will be understood by those skilled in the art, other aperture configurations can be utilized in the practice of the invention.

Figure 9B:
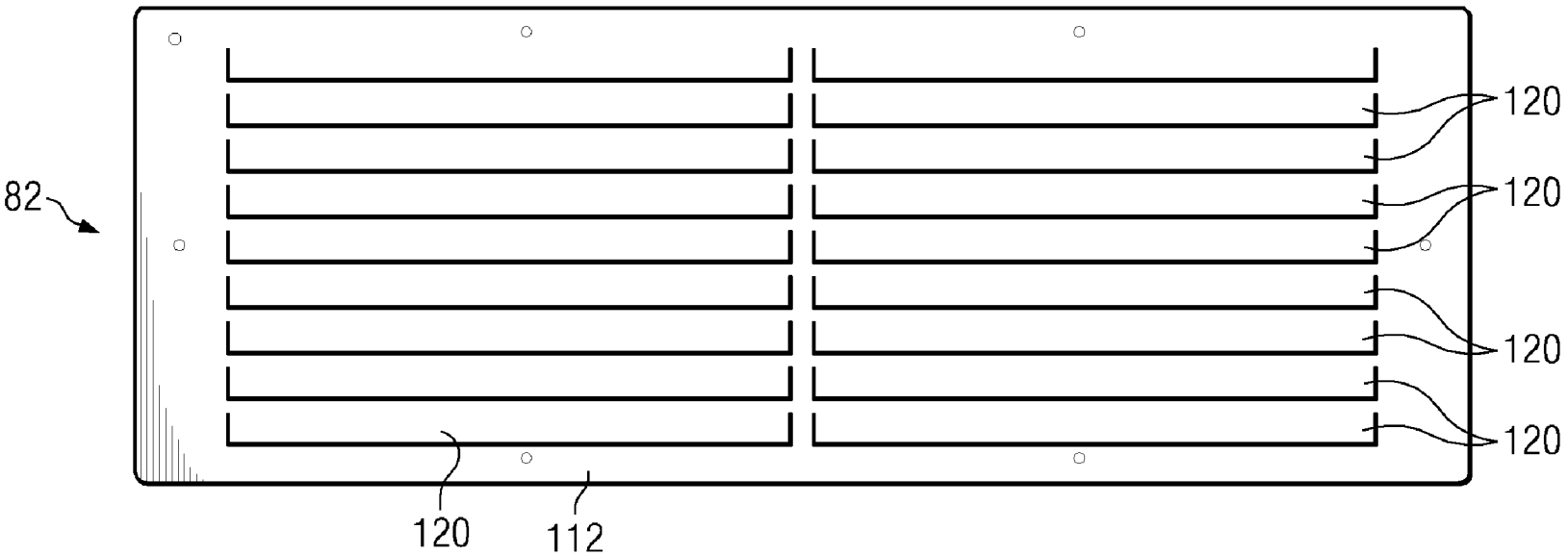

Each of the apertures 114 is fabricated by forming a relatively long first cut line 116 and two relatively short second cut lines 118 in the stainless steel plate 112 as illustrated in FIG. 9*b*. The second cut lines 118 extend angularly relative to the first cut line 116 from the opposite ends thereof. As illustrated in FIGS. 9*a* and 9*b*, the second cut lines 118 may extend perpendicularly relative to the first cut line 116, however, other angular relationships between the first cut line 116 and the second cut lines 118 may be utilized in the practice of the invention depending upon the requirements of particular applications thereof.

The first and second cut lines 116 and 118 are formed in the stainless steel sheet 112 utilizing a laser cutter. Multiple passes in the laser cutter may be required in order to form cut lines 116 and 118 having adequate width. After the cut lines 116 and 118 are formed, the portion of the stainless steel plate 112 extending between the two second cut lines 118 is bent out of the plane of the plate 112. A machine tool of the type known as a break is preferably utilized to bend the portion of the stainless steel plate 112 extending between the second cut lines 118 relative to the remainder thereof.

Bending of the portion of the plate 112 extending between the second cut lines 118 relative to the remainder of the plate 112 simultaneously forms both the aperture 114 and a louver 120 extending adjacent to the aperture 114. As stated above, the function of the apertures 114 is to facilitate viewing of the array of light emitting diodes comprising the LED sign 80. The function of the louvers 120 extending adjacent to the apertures 114 is to shield light emitting diodes from excessive light which would otherwise denigrate the contrast between the light emitting diodes and the background thereof thereby hindering the ability of visually impaired persons to read the LED sign 80.

The louvers 120 are further illustrated in FIG. 11. The louvers 120 are located along the upper edges of the corresponding apertures 114. FIG. 11 further illustrate the louver 120 as extending substantially perpendicularly relative to the plane of the stainless steel plate 112. However, the louvers 120 may extend angularly downwardly from the perpendicular orientation illustrated in FIG. 11. If the louvers 120 are bent into an angularly downwardly extending orientation, the extent of downward inclination of the louvers 120 from the perpendicular orientation shown in FIG. 11 is typically between about zero degrees and about 10 degrees.

The use of a laser cutting to form the cut lines 116 and 118 which define the apertures 114 and the use of the break to bend the portion of the stainless steel plate 112 extending between the second cut lines 118 thereby forming the apertures 114 and the louvers 120 comprises an important feature of the invention. By means of the present invention the expensive molds, dies, and/or other tooling which have heretofore been required to manufacture louvered cover plates for LED signs is eliminated. Thus, by means of the present invention costs of manufacturing LED sign covers is substantially reduced. Another important advantage deriving from the use of the invention comprises the fact that individual covers can be manufactured; that is, the necessity of forming multiple identical covers in order to amortize the cost of tooling necessary to make the covers is eliminated. Still another advantage deriving from the use of the present invention involves the fact that by means thereof covers for existing LED signs can be economically and rapidly fabricated. Use of the invention also facilitates the rapid and economical introduction of new cover plate designs.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A LED sign for urban transit vehicles comprising a substantially vertical array of light emitting diodes;

a cover overlying the entirety of the substantially vertical array of light emitting diodes, the cover comprising a substantially flat sheet formed from stainless steel which defines a predetermined plane;

a plurality of louvers for shielding the light emitting diodes from excessive light, each of the louvers comprising a portion of the stainless steel sheet that is integrally connected to the stainless steel sheet, the louvers having a first position wherein the louvers are positioned in a same plane as the plane of the cover and a second position wherein the louvers are bent into a predetermined angle relative to the plane of the cover, wherein once the louvers are moved from the first position to the second position they remain in the second position; and wherein the cover further defines a plurality of apertures to facilitate viewing of the light emitting diodes therethrough when the plurality of louvers are in the second position, each of the plurality of louvers located within a corresponding aperture when the plurality of louvers are within the first position before moving to the second position, each of the plurality of apertures defined by a space remaining in the cover when a corresponding louver moves from the first position to the second position.

2. The improvement according to claim 1 wherein substantially all of the apertures formed in the cover are substantially identical in size and shape and wherein substantially all of the apertures formed in the cover extend substantially parallel to one another.

3. The improvement according to claim 2 wherein the light emitting diodes comprising the LED signs are arranged in a rectangular array comprising the first relatively long dimension and a second relatively short dimension extending perpendicularly to the first relatively long dimension; and wherein the apertures formed in the cover extend substantially parallel to the first relatively long dimension characterizing the array of light emitting diodes.

4. A method of manufacturing a cover for a LED sign comprising an array of light emitting diodes characterized by predetermined dimensions including the steps of:

providing a sheet of opaque material which is dimensionally larger than the array of light emitting diodes comprising the LED sign;

forming at least one aperture in the sheet of opaque material to facilitate viewing of the light emitting diodes comprising the LED sign;

the aperture forming step including the step of forming a cut in the sheet of opaque material which comprises a first relatively long cut line and two relatively short second cut lines each extending angularly relative to the first cut line from the opposite ends thereof and bending the portion of the sheet of opaque material extending between the two second cut lines thereby simultaneously forming the aperture in the sheet of opaque material and a louver substantially equal in size to the aperture and positioned adjacent to the aperture which shields the array of light emitting diodes from excessive light and enables viewing of the light emitting diodes from a position perpendicular to a plane of the sheet of opaque material.

5. The method of according to claim 4 wherein the step of providing a sheet of opaque material is carried out by providing a stainless steel sheet.

6. The method of according to claim 5 wherein the step of forming the first and second cut lines is carried out by laser cutting the stainless steel sheet.

7. The method according to claim 6 wherein the step of forming first and second cut lines is carried out by forming second cut lines at the opposite ends of the first cut line which extend perpendicularly relative to the first cut line.

8. The method according to claim 7 wherein the cutting and bending steps are replicated thereby forming a plurality of apertures of the stainless steel sheet and a plurality of louvers each positioned adjacent one of the apertures.

9. A method of manufacturing a cover for a LED sign comprising an array of light emitting diodes characterized by predetermined dimensions including the steps of:

providing a stainless steel sheet which is dimensionally larger than the array of light emitting diodes comprising the LED sign;

forming a plurality of apertures in the stainless steel sheet to facilitate viewing of the light emitting diodes comprising the LED sign;

the aperture forming step including the steps of forming cuts in the stainless steel sheet each comprising a relatively long first cut line and two relatively short second cut lines each extending angularly relative to the first cut line from the opposite ends thereof; and bending the portions of the stainless steel sheet extending between the two second cut lines thereby simultaneously forming the apertures in the stainless steel sheet and louvers substantially equal in size to the apertures and positioned adjacent to the apertures which shield the array of light emitting diodes from excessive light and enables viewing of the light emitting diodes from a position perpendicular to a plane of the stainless steel sheet.

10. The method according to claim 9 wherein the steps of forming the first and second cut lines is carried out by laser cutting the stainless steel sheet.

11. The method according to claim 10 wherein the step of forming first and second cut lines is carried out by forming second cut lines at the opposite ends of the first cut lines which extend perpendicularly relative to the first cut lines.

12. The method according to claim 11 wherein the step of forming apertures in the stainless steel sheet is carried out by forming apertures which are substantially identical in size and shape and further characterized by forming apertures in the stainless steel sheet which extend substantially parallel to one another.

13. The method according to claim 12 wherein the light emitting diodes comprising the LED sign are arranged in a rectangular array comprising a first relatively long dimension and a second relatively short dimension extending perpendicularly to the first relatively long dimension and wherein the step of forming apertures in the stainless steel sheet is carried out by forming apertures which extend substantially parallel to the first long dimension characterizing the array of light emitting diodes.

* * * * *